US005687568A

United States Patent [19]

Buschur

[11] Patent Number: 5,687,568

[45] **Date of Patent: *Nov. 18, 1997**

[54] HYDRAULIC MOTOR SYSTEM

[75] Inventor: Jeffrey J. Buschur, Bellbrook, Ohio

[73] Assignee: ITT Automotive Electrical Systems, Inc., Auburn Hills, Mich.

[ * ] Notice: The term of this patent shall not extend beyond the expiration date of Pat. No. 5,561,978.

[21] Appl. No.: 614,495

[22] Filed: Mar. 13, 1996

Related U.S. Application Data

[63] Continuation of Ser. No. 341,426, Nov. 17, 1994, Pat. No. 5,561,978.

[51] Int. Cl.[6] ..... F16D 31/02; F15B 11/00

[52] U.S. Cl. ..... 60/424; 60/426; 60/435; 60/483; 91/517; 91/518

[58] Field of Search ..... 91/508, 511, 517, 91/518, 514, 520; 60/483, 435, 420, 424, 426, 468, 494

[56] References Cited

U.S. PATENT DOCUMENTS

| | | | |
|---|---|---|---|
| 3,421,389 | 1/1969 | Fauchere | 74/665 |
| 3,435,616 | 4/1969 | Waldorff | 60/97 |
| 3,757,524 | 9/1973 | Poyner et al. | 60/483 |
| 4,098,083 | 7/1978 | Carman | 60/414 |
| 4,179,888 | 12/1979 | Goscenski, Jr. | 60/420 |
| 4,711,090 | 12/1987 | Hartiala et al. | 60/422 |
| 4,799,851 | 1/1989 | Swanson | 414/700 |
| 5,199,525 | 4/1993 | Schueler | 180/242 |
| 5,347,812 | 9/1994 | Nilsson et al. | 60/494 |
| 5,535,845 | 7/1996 | Busghur | 60/424 X |

FOREIGN PATENT DOCUMENTS 3626013 9/1987 Germany .

OTHER PUBLICATIONS

*The Gerotor*–information packet describing a positive displacement pumping unit consisting of an inner and an outer rotor, 6 pgs.

Research Disclosure, "Hydraulic Powered Steering & Cooling System With Energy Savings Circuit", No. 369, Jul. 1994, Great Britain.

*Primary Examiner*—Hoang Nguyen

*Attorney, Agent, or Firm*—Thomas N. Twomey; J. Gordon Lewis

[57] ABSTRACT

A hydraulic motor system minimizes wasted power by using a plurality of fixed displacement hydraulic motors to drive a drive shaft in a cooperative manner. The motors are selectively switched into operation in response to variations in fluid pressure. As a consequence the hydraulic fluid acts upon a motor system having an effective combined displacement for producing a predetermined shaft rotation rate at the volumetric flow rate which caused the pressure condition. The invention is disclosed as having particular utility for driving a cooling fan for an automotive engine.

18 Claims, 4 Drawing Sheets

HYDRAULIC MOTOR SYSTEM

RELATED APPLICATION

This application is a continuation of Ser. No. 08/341,426 filed Nov. 17, 1994, now U.S. Pat. No. 5,561,778.

BACKGROUND OF THE INVENTION

This invention relates to the field of hydraulic motors and has particular application to hydraulic motors which are connected for driving cooling fans for automotive engines of the internal combustion type. Such engines typically are supplied with a liquid coolant which is circulated through a radiator. As the coolant flows through the radiator, it gives up heat to the radiator surfaces, which in turn are cooled by flowing air. If the radiator is mounted in a moving vehicle, a certain amount of cooling air is naturally generated. However, natural flow is undependable and entirely inadequate in a modern vehicle. Therefore it is customary to employ a cooling fan for producing a forced flow of cooling air.

Radiator cooling fans are driven by the engine, either via direct mechanical connection or indirectly with the aid of a fan motor. While a variety of motor types are available for such purposes, hydraulic motors are particularly desirable due to the availability of a hydraulic fluid supply in most automobiles. However, automotive hydraulic fluid is generally supplied by a fixed displacement pump driven by a fixed ratio mechanical connection to the engine. This means that the rate of flow of hydraulic fluid and the speed of the cooling fan will vary in direct proportion to the engine speed. This is not a desirable result because desired fan speeds vary over a considerably narrower range than the associated engine speeds.

It will be appreciated that the rotation of a cooling fan is opposed by a reaction torque due to aerodynamic drag which rises as the square of the rotational speed. This reaction torque is overcome by forces generated in the engine. The forces, so generated, pressurize the hydraulic fluid to a pressure which produces a driving torque that will balance the reaction torque, when applied across the projected area (work area) of a working surface positioned in a displacement chamber of the hydraulic motor. This causes a power drain upon the engine, which rises as the third power of the engine speed or fan speed. However, there is a practical limit on fan speed due to noise considerations, power drain and structural integrity of the fan.

Automotive engine speeds typically vary between about 600 rpm and 4,000 rpm, as the engine operation goes from idle to grade. This is a ratio of nearly 1:7. However, the fan speed requirement does not increase anywhere near that much. While specific fan speed requirements will vary widely with engine design, it has been found that the rotation speed at grade needs to be only about 1.5 to 2.0 times that at idle. Thus, if a fixed displacement hydraulic motor is designed to produce an ideal fan speed at idle, it will run several times faster than is necessary at grade. On the other hand, if the motor operates at the correct speed for grade, it will be unable to provide adequate cooling at idle. Heretofore the problem has been solved in one of two ways: (1) providing a variable displacement hydraulic pump, or (2) setting the work area of the motor for operation at idle and restricting the maximum permissible motor speed through use of a bypass line to divert hydraulic fluid not required for driving the fan. The first solution involves undesired complexity and expense, and the second wastes power. For a typical prior art fixed displacement motor, the wasted power has been found to be about 550 BTU per min. at an engine speed of 3050 rpm.

SUMMARY OF THE INVENTION

This invention provides a hydraulic motor system which is able to operate at speeds that are adjusted to meet the needs of the job. Such motor speed adjustments are accomplished by adjusting the work area of the hydraulic motor system in fixed increments. As applied to a drive mechanism for an automotive cooling fan, a plurality of hydraulic motors are provided and are switched into driving relationship with the fan in response to pressure conditions in the hydraulic supply fluid.

In accordance with the invention the work area of an hydraulic motor system is set to provide the ideal fan speed at engine idle. The work area is adjusted in response to fluid pressure at another operating condition, preferably at grade. Additional adjustments may be made as desired.

Preferably two hydraulic fan motors are connected for operation within parallel branches stemming from a common fluid supply line. One of these motors, an idle motor, is designed with a work area which provides the ideal speed for the cooling fan when the engine is at idle. This motor is in fixed driving connection with the cooling fan drive shaft. The second motor, a grade motor, is connected to the cooling fan drive shaft by means of an overriding slip clutch and does not power the fan at idle. A pressure sequencing valve is interposed between the grade motor and its branch of the fluid supply line. This valve is closed at idle, so that the grade motor is not powered at low engine speeds.

As the engine speed and hydraulic fluid flow rate increase, there is an increasing fluid pressure which begins opening the pressure sequencing valve. Hydraulic fluid then begins entering the grade motor. The grade motor then begins to rotate and gradually gains speed.

When the grade motor speed matches the speed of the fan shaft, the overriding slip clutch engages, and the grade motor begins contributing torque to the fan shaft. The torque contribution by the grade motor increases with any continuing increase in the flow rate of hydraulic fluid being pumped into the fluid supply line. This torque contribution by the grade motor increases until the pressure drop across the grade motor is approximately equal to that across the idle motor. At that point the two motors operate as a unit with a displacement equal to the sum of the two. This substantially avoids the wasting of engine power.

It is therefore an object of this invention to provide an improved hydraulic motor system able to change displacement as a function of input flow rate. It is another object of the invention to provide an improved hydraulic drive for an automotive cooling fan.

Other and further objects and advantages of the invention will be apparent from the following specification with its appended claims and the attached drawings.

DESCRIPTION OF THE PREFERRED EMBODIMENTS

Figure 1:
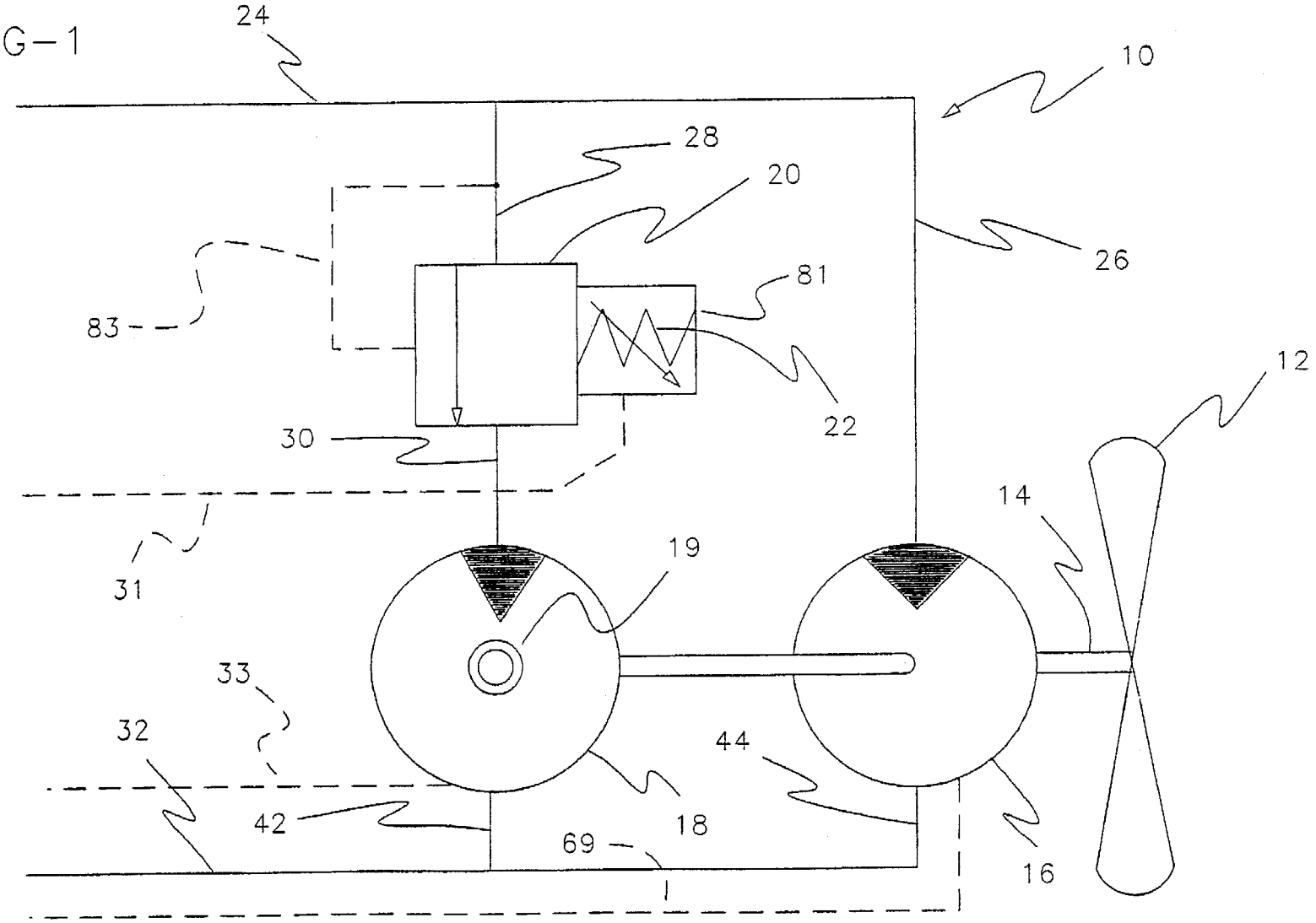
FIG. 1 is a schematic drawing of a pair of hydraulic motors operating in parallel.
Figure 2:
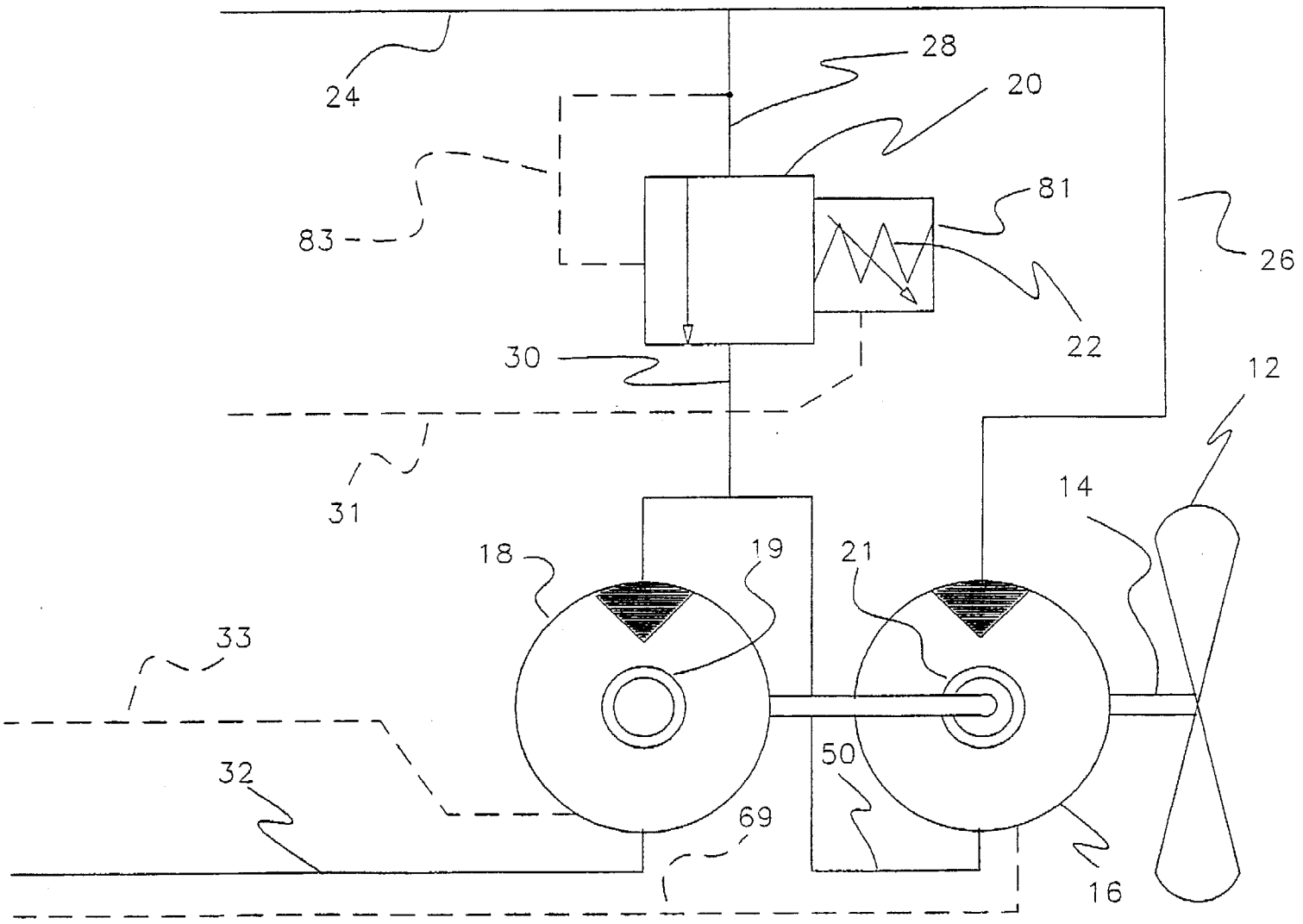
FIG. 2 is a schematic drawing of a pair of hydraulic motors operating in series.

The present invention contemplates hydraulic motor means for driving a load at a nearly ideal speed irrespective of the volumetric flow rate of hydraulic fluid supplied to the motor means. This is accomplished by adjusting the work area of working surface means positioned within displacement chamber means. More particularly, and in preferred embodiment, as illustrated in FIGS. 1 and 2, the hydraulic motor means may comprise a plurality of hydraulic motors each having a displacement chamber connected for reception of hydraulic fluid from a common supply line. For driving an automotive cooling fan 12 the arrangement may comprise an idle motor 16 and a grade motor 18 connected in parallel as illustrated in FIG. 1 or in series, as illustrated in FIG. 2. The best mode is the parallel arrangement of FIG. 1. Referring now to that Figure, idle motor 16 is mounted fast to a drive shaft 14 connected to cooling fan 12. Idle motor 16 has a displacement chamber which houses a working surface (not illustrated in FIG. 1) for driving shaft 14. The working surface has a work area which is rotated by pressurized hydraulic fluid in a branch line 26 connected to an input port of idle motor 16. Idle motor 16 may be of conventional design and may take a variety of forms.

Branch line 26 is connected to a supply line 24 which in turn is connected to a pump (not illustrated) powered by an automotive engine. Supply line 24 is connected to a pump (not illustrated) that supplies hydraulic fluid at a volumetric rate which is directly proportional to the speed of the automotive engine. Part of that flow is bypassed through a bypass line (not illustrated) at high engine speeds. When the automotive engine is operating at idle speed all of the hydraulic fluid flows through branch line 26 and into idle motor 16 to produce rotation of shaft 14. The work area of the working surface carried by idle motor 16 is designed such that it causes shaft 14 to rotate at the desired speed when the engine is idling and delivering hydraulic fluid into line 24 at the volumetric rate corresponding thereto. The size of the work area $A_i$ may be calculated from the equation:

$$A_i = \frac{V_i}{R_i M_i}$$

Where:

$V_i$=volumetric flow rate of hydraulic fluid at idle speed, $R_i$=ideal or desired fan rotation rate (radians per sec.) at idle speed, and $M_i$=is the moment arm of the work area $A_i$.

In general $V_i$ is known and $R_i$ is specified. In accordance with this invention the idle motor is configured to provide an area-moment product $A_iM_i$ which is equal to $V_i/R_i$. Then so long as valve 20 remains closed, the rotational speed R of fan 12 for any flow rate V will be given by the equation:

$$R = \frac{V}{A_i M_i}$$

The flow rate V and the fan speed R both increase with increasing engine speed. This invention contemplates an increase in the area-moment product before R reaches its grade speed value $R_g$, thereby reducing the rate of increase in R. The increase in area-moment product is achieved by diverting part of the hydraulic fluid flow through grade motor 18 when the fluid pressure in supply line 24 reaches a predetermined level.

The relationship between fan speed R and the line pressure P is:

$$P = \frac{TR}{V}$$

where T is the torque generated by the drive motor against shaft 14.

Grade motor 18 is connected to supply line 24 by a branch line 28, a pressure sequencing valve 20 and another branch line 30. Pressure sequencing valve 20 is closed when the automotive engine is idling, so that grade motor 18 does not drive fan 12 at this time. Grade motor 18 is connected to shaft 14 by an overriding slip clutch 19 so as to avoid interference with rotation of shaft 14 during the idle operation.

As the automotive engine gains speed, the volumetric flow rate of hydraulic fluid increases in lines 24 and 26, thereby causing a proportional increase in the rotational speed of fan 12. As fan 12 speeds up, it generates an increasingly large reaction torque which in turn causes an increase in the pressure of the hydraulic fluid being supplied by the automotive engine.

The pressure sequencing valve 20 has a spring 22 which yields under increasing pressure in a line 83 which is connected to supply line 24. This causes valve 20 to begin opening as the pressure in line 24 increases. The spring constant of spring 22 is selected so as to enable full opening of pressure sequencing valve 20 sometime after idle and before the pressure in line 24 reaches that value associated with grade operation.

As valve 20 begins opening, hydraulic fluid flows from line 24 into branch line 28, through valve 20 and branch line 30 into a displacement chamber (not illustrated in FIG. 1) within grade motor 18. A working surface is positioned within this displacement chamber to cause grade motor 18 to begin turning at a speed lower than the speed of shaft 14, upon arrival of hydraulic fluid.

As the flow to supply line 24 increases, there is a concomitant flow rate increase through line 30 and grade motor 18. Meanwhile, the pressure across idle motor 16 remains approximately constant. When the flow through line 30 reaches the point at which grade motor 18 has attained the speed of shaft 14, clutch 19 engages. Grade motor 18 then begins to contribute torque to the fan shaft. As the flow through grade motor 18 increases, the pressure drop across the grade motor likewise increases. This pressure drop increases until it is equal to the pressure drop across idle motor 16. During the period of increasing pressure drop across grade motor 18, the pressure drop across idle motor 16 remains nearly constant, and the differential appears across pressure sequencing valve 20.

After the pressure drop across grade motor 18 equals the pressure drop across idle motor 16, the pressure in line 24 begins increasing. At this time fan 12 has achieved a speed $R_g$, and motors 16, 18 are working with a total area-moment equal to the ratio $V_g/R_g$. In order to achieve this total area-moment, grade motor 18 has a displacement chamber 38 configured with an area-moment selected in accordance with the formula:

$$A_g M_g = \frac{V_g}{R_g} - A_i M_i$$

As also illustrated in FIG. 1, hydraulic motors 16, 18 are connected to discharge lines 44, 42 respectively, and these discharge lines are joined to a return line 32. FIG. 1 further illustrates motor drain lines 69 and 33 which serve to drain seal cavities (not illustrated) in motors 16, 18 respectively.

There is also a drain line 31 draining a spring cavity 81 housing reaction spring 22 for pressure sequencing valve 20. Drain line 31 is connected to a reference pressure source for valve 20. This reference pressure source may be common to line 69, 33 and/or line 32 or some other reference.

FIG. 2 illustrates an alternative arrangement wherein idle motor 16 and grade motor 18 are arranged in series. In this arrangement idle motor 16 has a clutch 21 for connection to drive shaft 14. There is a connection line 50 which carries hydraulic fluid from the output side of idle motor 16 to the input side of grade motor 18. In this arrangement, both motors turn at low flow rates, but only grade motor 18 turns at the grade condition. Other arrangements are feasible, including arrangements employing additional hydraulic motors and arrangements employing valves in more than one branch line.

Figure 3:
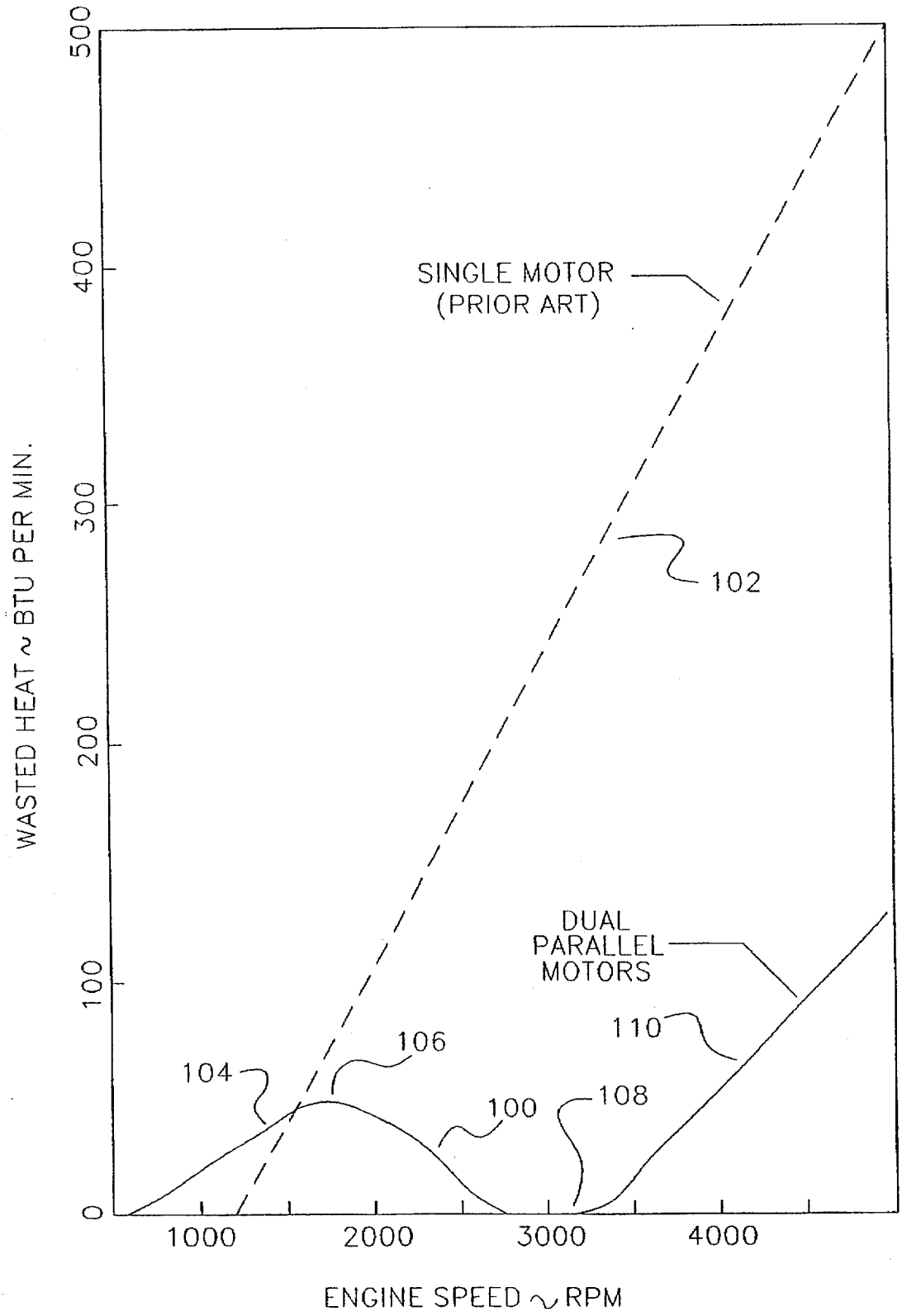
FIG. 3 is a graphical plot illustrating the power wasted by fan motors operating over a range of engine speeds.

FIG. 3 illustrates the effectiveness of the arrangement of FIG. 1 in minimizing wasted power. For any fan speed R there is a corresponding reaction torque T and an associated power consumption $2\pi R$. At any given fan speed there is an ideal pump speed which produces the needed amount of hydraulic flow. Any power consumption attributable to an excess hydraulic flow may be regarded as wasted. However, FIG. 3 assumes that there is no waste at engine speeds below that which produces the maximum desired fan speed. FIG. 3 therefore plots wasted power for a typical automotive cooling system according to the equation:

$$WP=8.27\times10^{-5}P(ES-ES_{mf})$$

where P is the fluid pressure in lb. per. in$^2$ and ES is the engine speed.

The above equation assumes a pulley ratio of 1.12 and a pump displacement of 0.689 in$^3$ per revolution. The plot of FIG. 3 assumes that P has a value of 1600 psi and that the engine speed for max fan, $ES_{mf}$, is 1200 rpm (twice the idle speed). The resulting values of WP are plotted in FIG. 3 as a function of engine speed for dual parallel motors (curve 100) and for a single motor (curve 102). Curve 102 has a steep, constant slope which wastes power at a rapid rate. In comparison curve 100 has an initial gradual slope, as indicated by the curve portion 104. The slope then falls off and goes negative at an engine speed of about 1760 rpm, where valve 20 begins opening (curve portion 106). The wasted power is eliminated entirely at a grade speed of about 3000 rpm (curve portion 108) and then rises again at speeds in excess of grade (curve portion 110).

Figure 4:
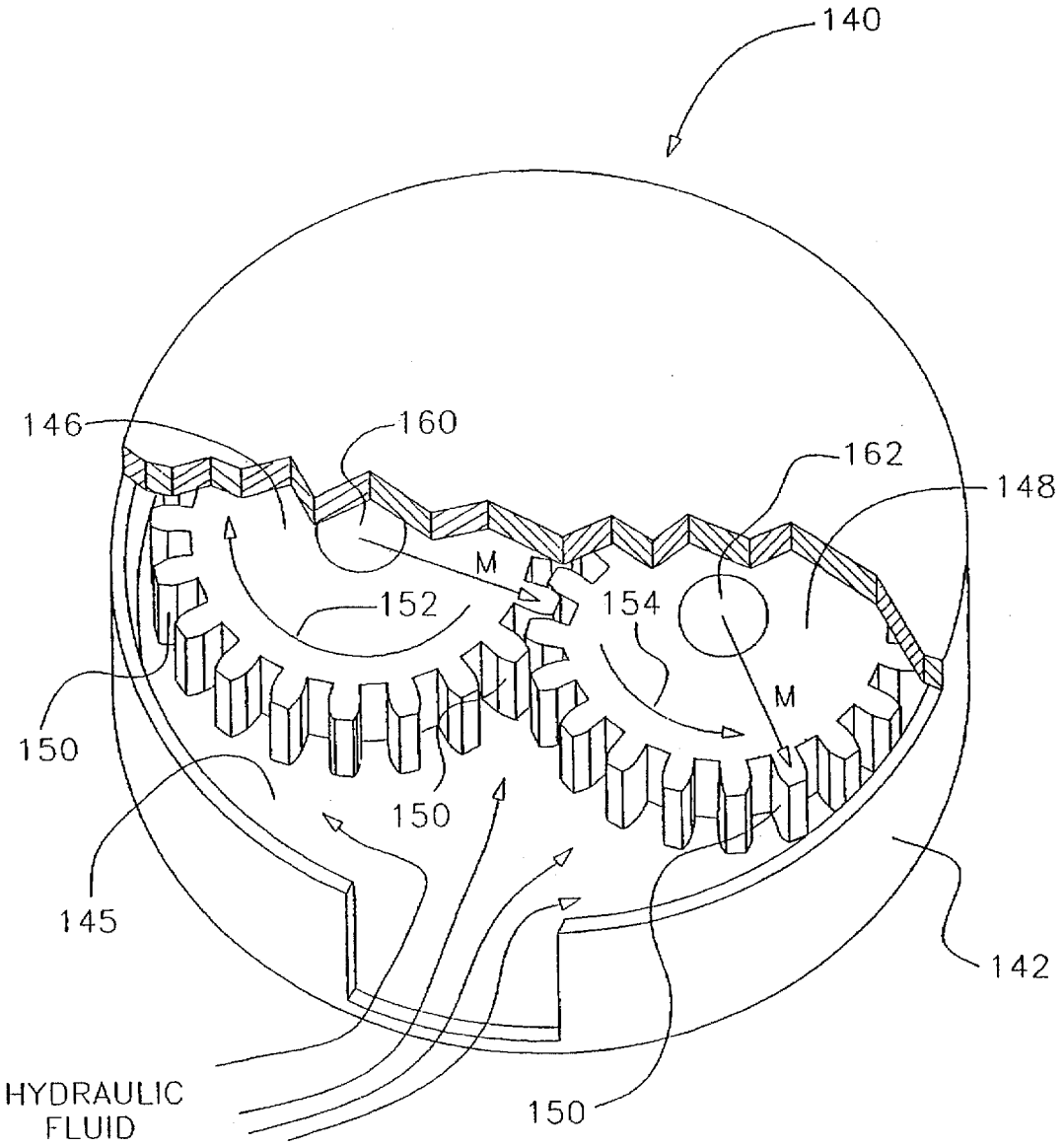
FIG. 4 is a partially cut-away perspective drawing of a displacement chamber for a rotary hydraulic motor.

FIG. 4 illustrates a work area and a moment arm for a typical spur gear hydraulic motor 140. It will be understood that other types of hydraulic motors could be used and that a spur gear hydraulic motor is illustrated only for purposes of explanation of the terms used in this application. For instance, a gerotor type hydraulic motor is generally less expensive and is preferred over the specific arrangement illustrated in FIG. 4.

The hydraulic motor of the illustration includes a housing 142 in which are mounted two inter-meshing spur gears 146, 148 mounted on shafts 160, 162 respectively. Hydraulic fluid flows into a displacement chamber 145 and out through an exit port (not illustrated). It will be understood that one of the shafts 160, 162 will be connected to fan shaft 14. The working surfaces of motor 140 are the upstream faces 150 of the teeth of spur gears 146, 148. As the hydraulic fluid acts on the faces 150 there is a net torque which produces rotation of gears 146, 148 in the directions illustrated by arrows 152, 154. The net torque is produced by reason of the fact that the hydraulic fluid exerts a net force upon three tooth faces 150 at any point in time. Two of those faces act cooperatively and are associated with two teeth (one on each gear) just becoming tangent to the inside surface of housing 142. The third active face 150 is associated with a tooth just coming into mesh between the two gears 146, 148. This third face 150 produces a torque opposing the rotation illustrated by the arrows 152, 154. The work area A of displacement chamber 145 then is equal to the area 150 of a single tooth. The moment arm of that area switches back and forth between gears 146, 148 and is illustrated by two arrows M of FIG. 4.

As indicated previously this invention involves selection of at least two area-moment products AM so as to reduce wasted power. It will be appreciated that the area-moment product is dimensionally equivalent to a volume, and, in fact, is equal to displacement per radian. It is also equal to $\frac{1}{2}\pi$ times the displacement per revolution, a more familiar term to those in the field.

As applied to an arrangement of the type illustrated in FIG. 4, the area-moment product may be adjusted by adjusting either the radii of the gears 146, 148 or the size of the teeth. The tooth size may be adjusted by changing either the tooth length or the thickness in a direction parallel to the axes of shafts 160, 162. Any of these adjustments will likewise adjust the displacement per revolution.

While the forms of apparatus and the method herein described constitute preferred embodiments of this invention, it is to be understood that the invention is not limited to these precise forms of apparatus and method, and that changes may be made therein without departing from the scope of the invention which is defined in the appended claims.

What is claimed is:

1. An hydraulic drive apparatus comprising:

(a) a supply line for receiving an hydraulic fluid;

(b) displacement chamber means defining a plurality of displacement chambers, each connected to said supply line for progressive filling by said hydraulic fluid in response to an increase of flow rate in said supply line;

(c) a plurality of working surfaces, each positioned within one of said displacement chambers for movement in response to said progressive filling; and (d) flow division means for apportioning the flow of said hydraulic fluid between said displacement chambers; said at least one of said plurality of working surfaces being coupled to a drive shaft and applying a tongue to drive said shaft for driving a component.

2. A method of driving a shaft coupled to a hydraulic load, comprising the steps of:

applying torque to the shaft with a first motor; and applying torque to the shaft with a second motor, wherein torque is applied to the shaft simultaneously by the first motor and the second motor for a period of time wherein;

the hydraulic load is driven in response to a flow of hydraulic fluid delivered by a pump which is powered by an engine operable at grade operation and idle operation, the first motor torque applying step includes the step of applying torque to the shaft during idle operation and grade operation, and the second motor torque applying step includes the step of applying torque to the shaft during grade operation and applying no torque to the shaft during idle operation.

3. A method of driving a shaft coupled to a hydraulic load, comprising the steps of:

applying torque to the shaft with a first motor; and applying torque to the shaft with a second motor, wherein torque is applied to the shaft simultaneously by the firs motor and the second motor for a period of time wherein the first torque applying step further includes the step of mechanically coupling the first motor to the shaft during both idle operation and grade operation, and the second torque applying step further includes the step of mechanically decoupling the second motor from the shaft during idle operation, and mechanically coupling the second motor to the shaft during grade operation.

4. A method of driving a shaft coupled to a hydraulic load, comprising the steps of:

applying torque to the shaft with a first motor; and applying torque to the shaft with a second motor, wherein torque is applied to the shaft simultaneously by the first motor and the second motor for a period of time wherein;

the second torque applying step further includes the step of mechanically coupling the second motor to the shaft during grade operation with a slip clutch.

5. The method of claim 2, wherein:

the first motor torque applying step further includes the step of allowing the first motor to be in fluid communication with the flow of hydraulic fluid during both idle operation and grade operation, and the second motor torque applying step further includes the step of preventing the second motor from being in fluid communication with the flow of hydraulic fluid during idle operation, and causing the second motor to be in fluid communication with the flow of hydraulic fluid during grade operation.

6. The method of claim 5, wherein the second motor torque applying step further includes the step of preventing the second motor from being in fluid communication with the flow of hydraulic fluid during idle operation with a pressure sensitive valve.

7. The method of claim 5, wherein:

the first motor torque applying step further includes the step of mechanically coupling the first motor to the shaft during both idle operation and grade operation, and the second motor torque applying step further includes the step of mechanically decoupling the second motor from the shaft during idle operation, and mechanically coupling the second motor to the shaft during grade operation.

8. A system for driving a fan shaft in response to a flow of hydraulic fluid delivered by a pump which is powered by an engine operable at idle speed and at grade speed, comprising:

a first motor coupled to said fan shaft in fluid connection with said pump during idle operation and during grade operation;

a second motor coupled to said fan shaft; and a fluid connection for placing said second hydraulic motor into fluid connection with said pump during grade operation and preventing said second hydraulic motor from being in fluid connection with said pump during idle operation.

9. The system of claim 8, wherein said first motor is in mechanical driving connection to said shaft during idle operation and during grade operation.

10. The system of claim 9, further comprising a mechanical connection which connects said second hydraulic motor to said shaft during grade operation and disconnects said second hydraulic motor from said shaft during idle operation.

11. The system of claim 10, wherein said mechanical connection includes a slip clutch.

12. The system of claim 8, wherein said fluid connection includes a pressure sensitive valve.

13. A system for driving a fan shaft in response to a flow of hydraulic fluid delivered by a pump which is powered by an engine operable at idle speed and at grade speed, comprising:

a first hydraulic motor in mechanical driving connection to said shaft during idle operation and during grade operation;

a second hydraulic motor; and a mechanical connection which connects said second hydraulic motor to said shaft during grade operation and disconnects said second hydraulic motor from said shaft during idle operation.

14. The system of claim 13, wherein said first hydraulic motor is in fluid connection with said pump during idle operation and during grade operation.

15. The system of claim 14, further comprising a fluid connection for placing said second hydraulic motor into fluid connection with said pump during grade operation and preventing said second hydraulic motor from being in fluid connection with said pump during idle operation.

16. The system of claim 15, wherein said fluid connection includes a pressure sensitive valve.

17. The system of claim 13, wherein said mechanical connection includes a slip clutch.

18. A hydraulic motor system for driving a shaft which is connected to an automotive cooling fan in response to a flow of hydraulic fluid delivered by a fixed displacement pump which is powered by a variable speed engine operable at idle speed and at grade speed, comprising:

a first hydraulic motor in fluid connection with said pump during idle operation and during grade operation, and in mechanical driving connection to said shaft during idle operation and during grade operation;

a second hydraulic motor;

a slip clutch which connects said second hydraulic motor to said shaft during grade operation and disconnects said second hydraulic motor from said shaft during idle operation; and a pressure sensitive valve for placing said second hydraulic motor into fluid connection with said pump during grade operation and preventing said second hydraulic motor from being in fluid connection with said pump during idle operation.

* * * * *